US009580242B2

(12) United States Patent
Van Veen

(10) Patent No.: US 9,580,242 B2
(45) Date of Patent: Feb. 28, 2017

(54) DEVICE FOR COLLECTING SOILED OBJECTS

(71) Applicant: Sanalife B.V., Epse (NL)

(72) Inventor: Anthonius Gerardus Adrianus Van Veen, Naaldwuk (NL)

(73) Assignee: Sanalife B.V., Epse (NL)

( * ) Notice: Subject to any disclaimer, the term of this patent is extended or adjusted under 35 U.S.C. 154(b) by 0 days.

(21) Appl. No.: 14/387,536

(22) PCT Filed: Mar. 22, 2013

(86) PCT No.: PCT/NL2013/050208
§ 371 (c)(1),
(2) Date: Sep. 23, 2014

(87) PCT Pub. No.: WO2013/147592
PCT Pub. Date: Oct. 3, 2013

(65) Prior Publication Data

US 2015/0090720 A1 Apr. 2, 2015

(30) Foreign Application Priority Data

Mar. 26, 2012 (NL) ..... 1039491

(51) Int. Cl.
*B65D 51/18* (2006.01)
*B65F 1/06* (2006.01)
*B65F 1/10* (2006.01)

(52) U.S. Cl.
CPC ..... *B65F 1/067* (2013.01); *B65F 1/10* (2013.01); *B65F 1/06* (2013.01); *B65F 1/062* (2013.01);
(Continued)

(58) Field of Classification Search
CPC ..... B65F 1/105; B65F 2240/132; B65F 1/06; B65F 1/062; B65F 1/065; B65F 1/067;
(Continued)

(56) References Cited

U.S. PATENT DOCUMENTS 1,333,051 A * 3/1920 Young ..... 220/252
3,536,192 A * 10/1970 Couper ..... 206/303
(Continued)

FOREIGN PATENT DOCUMENTS

WO 2006/126879 A2 11/2006

*Primary Examiner* — Fenn Mathew
*Assistant Examiner* — Elizabeth Volz
(74) *Attorney, Agent, or Firm* — Bret E. Field; Bozicevic, Field & Francis LLP

(57) ABSTRACT

A device for collecting soiled objects, such as used diapers, comprising a collecting container (1) closable by a cover (2) having a cover section (6) with a tubular chamber (7) open at one end providing an inlet/outlet opening (8), said cover section (6) being movable between a first position, in which an object may be deposited from the outside through said opening (8) into said chamber (7), and a second position, in which said object may drop through said opening (8) into the collecting container (1) and a transfer bag (12) of a flexible material removably mounted within said chamber (7), said bag (12) being open at one end and having a bottom cooperating with an expel body (11*d*) at the opposite end, wherein the collar (12*b*) of the transfer bag (12) is attached to said opening (8) by a locking ring (13).

18 Claims, 7 Drawing Sheets

(52) U.S. Cl.
CPC ..... *B65F 1/065* (2013.01); *B65F 1/105* (2013.01); *B65F 2001/061* (2013.01); *B65F 2240/132* (2013.01); *Y10S 220/908* (2013.01); *Y10S 220/9081* (2013.01)

(58) Field of Classification Search
CPC ..... B65F 2001/061; B65D 1/10; B65D 1/06; B65D 1/067; Y10S 220/908; Y10S 220/9081
USPC ..... 220/495.08, 495.01, 908, 908.1, 252, 220/254.1
See application file for complete search history.

(56) References Cited

U.S. PATENT DOCUMENTS 4,427,110 A * 1/1984 Shaw, Jr. ..... 206/205
4,869,049 A * 9/1989 Richards et al. ..... 53/459
4,934,529 A * 6/1990 Richards et al. ..... 206/303
5,046,614 A * 9/1991 Torres et al. ..... 206/366
5,535,913 A * 7/1996 Asbach et al. ..... 220/495.08
5,651,231 A * 7/1997 Garland ..... 53/258
5,765,339 A * 6/1998 Garland ..... 53/258
6,128,890 A * 10/2000 Firth ..... 53/567
6,516,588 B2 * 2/2003 Jensen et al. ..... 53/459
7,100,767 B2 * 9/2006 Chomik et al. ..... 206/409
7,114,314 B2 * 10/2006 Stravitz ..... 53/567
7,316,100 B2 * 1/2008 Stravitz et al. ..... 53/211
7,617,659 B2 * 11/2009 Stravitz et al. ..... 53/567
8,087,532 B2 * 1/2012 Brown et al. ..... 220/264
8,127,519 B2 * 3/2012 Stravitz ..... 53/469
8,215,089 B2 * 7/2012 Stravitz ..... 53/567
8,474,642 B2 * 7/2013 Chen ..... 220/252
8,833,592 B2 * 9/2014 Dunn et al. ..... 220/495.06
2007/0125792 A1 * 6/2007 Pollack et al. ..... 220/908.2
2007/0246465 A1 * 10/2007 Stravitz et al. ..... 220/200
2010/0089926 A1 * 4/2010 Lacy et al. ..... 220/521
2010/0133271 A1 * 6/2010 Garland ..... 220/254.1
2010/0301050 A1 * 12/2010 Garland ..... 220/495.08
2011/0056967 A1 * 3/2011 Ohnishi et al. ..... 220/694

* cited by examiner

DEVICE FOR COLLECTING SOILED OBJECTS

The invention relates to a device as described in the preamble of claim 1.

Such a device is disclosed in Dutch patent 1029093 (vide also WO2006/126879 A2).

In these publications an improved cleanability of the parts which—in use—get into contact with the soiled objects, is mentioned as an advantage of the flexible transfer bag within the chamber.

More specifically it is said that the transfer bag (indicated in de publications by the terms "mof", "sok", "kous" and "sleeve") can be easily cleaned from the inside.

With the well-known device, however, the chamber wall surface remains subjected to fouling. This fouling takes place—on the one hand directly—when placing a soiled object—and on the other hand indirectly—due to the ejection of an object taking place while the transfer bag, the inner side of which was fouled already in an earlier stage, is turned inside out. Moreover, the removal of a fouled transfer bag, e.g. for the purpose of a thorough cleaning or replacement, is rather difficult. This is because the edge around the mouth of the transfer bag is (halfway the chamber) locked up in a circumferential groove of the chamber wall by means of a radially outwardly pretensioned locking ring, which—because of its nature—can be is easily put in place but is difficult to remove.

It is a first object of the invention to provide a device of the type above referred to, that offers better possibilities for a thorough cleaning of the parts which—in use—are subjected to fouling and more particularly offers the desired ease with which such possibilities may be utilized and thereby the ease with which a high standard of hygiene may be satisfied.

According to the invention a device of the type above referred to is characterized in that the transfer bag is attached to a collar, which is rigid as compared with the flexibility of the bag material and the height of which is of the order of half the length of said chamber, which collar—together with said transfer bag—can be moved into/out of said chamber and locked therein against undesired outward movement by means of a locking ring that cooperates with the edge of said opening.

Such a flexible transfer bag provided with a rigid collar can be simply placed into and removed from the chamber through the easily accessible and easily manageable locking ring. In fact, the collar constitutes a lining for the chamber wall, which is thereby—in use—protected against direct as well as indirect fouling.

In a practical embodiment of the device according to the invention the locking ring forms an integral part of the collar.

A thus formed transfer bag assembly is particularly advantageous in circumstances, wherein for economic reasons cleaning can be carried out less frequently and therefore—from a point of view of hygiene—one decides to exchange the transfer bag assembly earlier. In these circumstances it is a real advantage, that automatically the locking ring (subjected to fouling when depositing as well as when expelling a soiled object) is exchanged as well.

A preferred embodiment of the collar is characterized in that starting from a collar neck portion, that corresponds with the inlet/outlet opening, the collar widens into a conical form and is—against spring action—radially inwardly contractible or compressible to a circumferential size that corresponds with the size of the inlet/outlet opening, e.g. as a result of the collar being provided with cuts or slits which are evenly divided around the terminal edge of the collar that is turned away from the collar neck portion.

When using a transfer bag assembly with such a cone-shaped collar in a cylindrical chamber (section) having a diameter that corresponds with that of the inlet/outlet opening, the collar will become lying against the cylindrical chamber wall in its radially compressed state, i.e. under pressure, which contributes to the reliability in operation of the device.

It has still to be noted that with the well-known device discussed hereinabove both ends of the chamber are open and function as inlet/outlet opening, in the sense, that each time one chamber end fulfils the function of outlet opening, while the other chamber end is in the inlet (deposit) position. This means that also in periods of time, in which there is no "supply" of soiled objects, the chamber containing the transfer bag that was fouled by previous use, is in direct connection with the surrounding atmosphere, which is also very undesirable from a point of view of hygiene.

With the device according to the invention, on the contrary, only one end of the chamber fulfils the function of inlet/outlet opening whereas the other end of the chamber is closed. Therefore, when placing the device into the outlet position—as a closing action after the deposit of a soiled object—the chamber is automatically shut off from the surrounding atmosphere and this situation continues until a next (soiled) object has to be disposed of.

As compared with the well-known device the device according to the invention has still the additional advantage that also the expel body remains out of contact with the soiled objects, without requiring therefore any material connection with the transfer bag, which facilitates the handling of the transfer bag when the latter is to be removed in order to be exchanged or cleaned.

In view of the circumstance just mentioned it is a further object of the invention to optimize the working of an expel body that is permanently disconnected from the transfer bag, with a device according to the invention.

To that end the invention provides a solution, which starts from a device according to claim 1 with at least also the feature of either claim 5 or 6, and which is characterized in that starting from said inlet/outlet opening, the chamber wall is at first conically widening through a length corresponding to the collar height and then—from a location halfway the chamber—conically narrowing, the cone angles of both of the chamber wall sections being smaller than that of the collar in its completely expanded, tensionless state.

With this solution the diameter of the expel body can be simply adjusted to the cone-shaped chamber wall and the cone-shaped collar respectively such that two defined end positions are created for the expel body, between which positions the expel body, when moving from the inlet position to the expel position and vice versa, may carry out an effective stroke. More specifically this manner of operation may result in a limitation of the extent to which the flexible transfer bag will—in the expel phase—be pushed by the expel body into the collar, so that with the next following movement towards the inlet (deposit) position it will be easier for the transfer bag to follow the expel body in its fall movement back to the chamber bottom.

Finally, a solution which is effective independent of the features of any subclaim consists therein that within the chamber a second or auxiliary bag is provided, the mouth edge of which engages the chamber wall round about so as to divide the chamber into two sections located one behind the other, and the flexible circumferential wall of which hangs down—when said cover section is in said first position—into the chamber section located at the closed end of the chamber, around the end of the transfer bag also hanging down therein, the bottom of said auxiliary bag being constituted by said expel body.

In this particular embodiment of the device according to the invention, the expel body is in the expel phase—wherein the chamber is moving and has been moved from the first position into the second position—operating in a manner which is comparable to the one with the well-known device. Indeed, in that phase the expel body will—although mechanically disconnected from the transfer bag, get positioned on top of the loaded transfer bag and push the latter downwardly, whereby the object is expelled and the transfer bag will get hanging—with its bottom directed downwardly and turned inside out—within the collar. Furthermore the auxiliary bag gets positioned—with its mouth edge suspending from the chamber wall—within the transfer bag turned inside out.

However, when the chamber is returning from the second position towards and into the first position—the deposit phase—the cooperation between the expel body and the transfer bag differs fundamentally from that with the well-known device. In this connection it is assumed that the fastening of the mouth edge of the auxiliary bag to the chamber wall as well as the fastening of the collar of the transfer bag in the inlet/outlet opening by means of the locking ring are (substantially) hermetic.

Under the condition just mentioned an amount of air will get trapped between the two flexible bags, which constitutes as it were a pneumatic connection between the transfer bag and the bottom (=expel body) of the auxiliary bag. In the deposit phase—when the expel body due to its weight returns to its starting position at the chamber end turned away from the deposit/outlet opening—this will create a slight under-pressure within the connecting "air-cushion" between the two bags, under the influence of which the transfer bag will be pulled along into its starting position—ready for receiving a (next) object. Unlike the well-known device, with which the expel body has to be mechanically connected to the transfer bag, such a connection is missing with the device according to the invention, thanks the use of an auxiliary bag that is not subjected to fouling and thus gives long lasting service. This means that, when a (very) fouled transfer bag has to be exchanged for a clean one, no expel body needs to disconnected from the fouled transfer bag, which is a great advantage from a point of view of hygiene.

Furthermore the invention relates to a transfer bag for use with the device according to the invention.

The invention is hereinafter further explained by way of two examples with reference to the accompanying drawings, in which.

Figure 1:
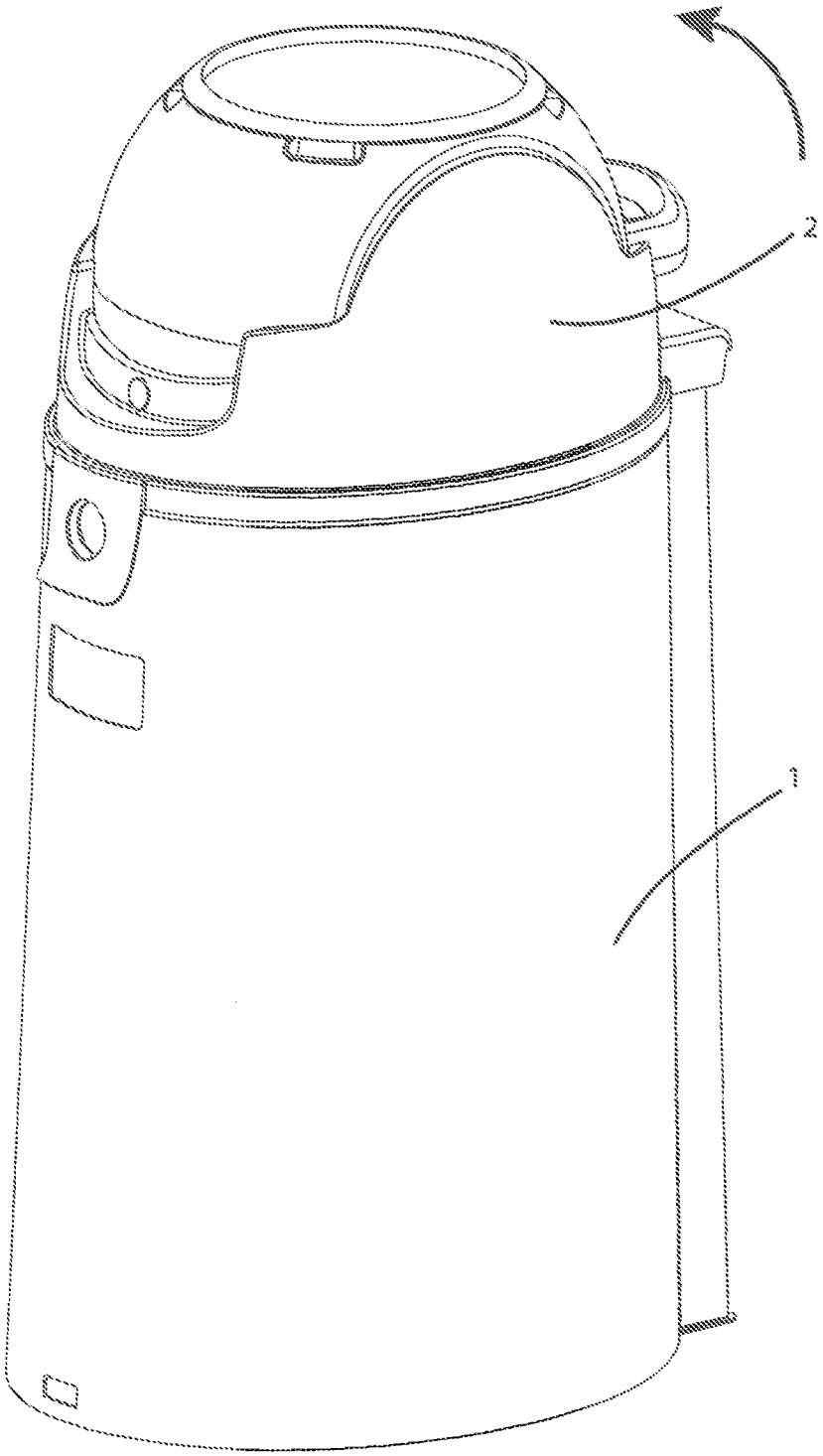
FIG. 1 is a perspective view of a device according to the invention in a first or deposit position, wherein the chamber within the cover is ready for receiving a soiled object.
Figure 2:
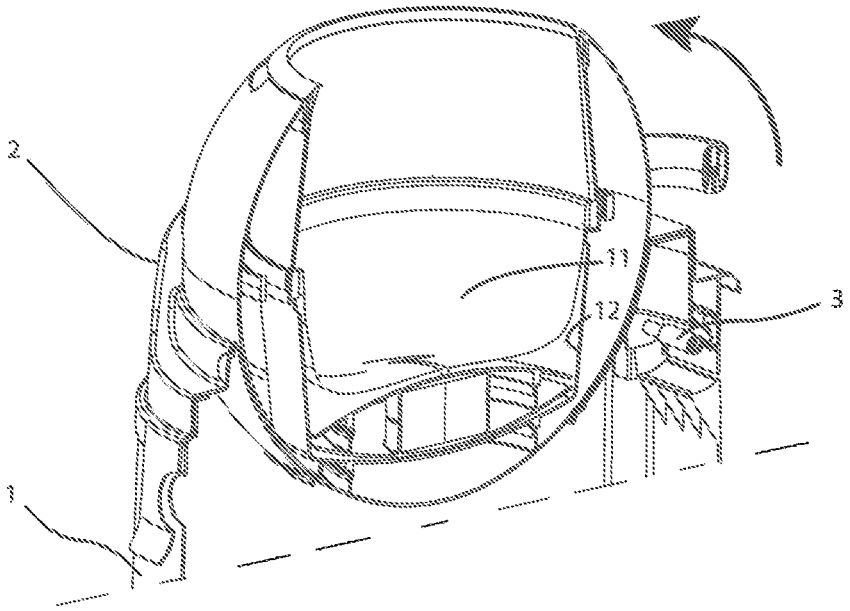
FIG. 2 is a perspective view of the upper part of the device according to FIG. 1, wherein the upper part is vertically cut through to show its interior with the auxiliary bag/transfer bag assembly therein.
Figure 5:
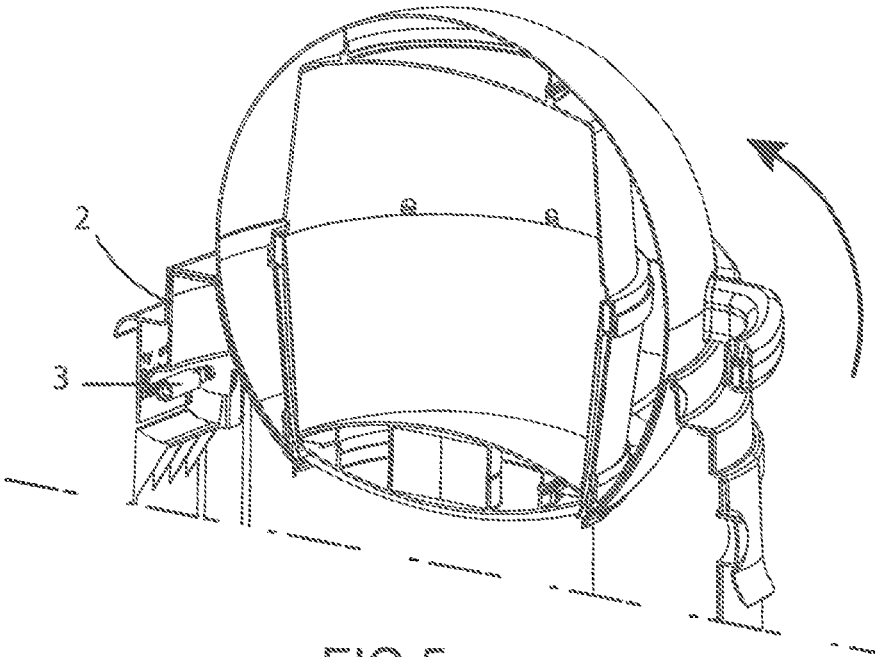
FIG. 5 is a perspective view of the vertically sectioned upper part of the device according to FIG. 1, but now with the chamber in a second or expel position.
Figure 6:
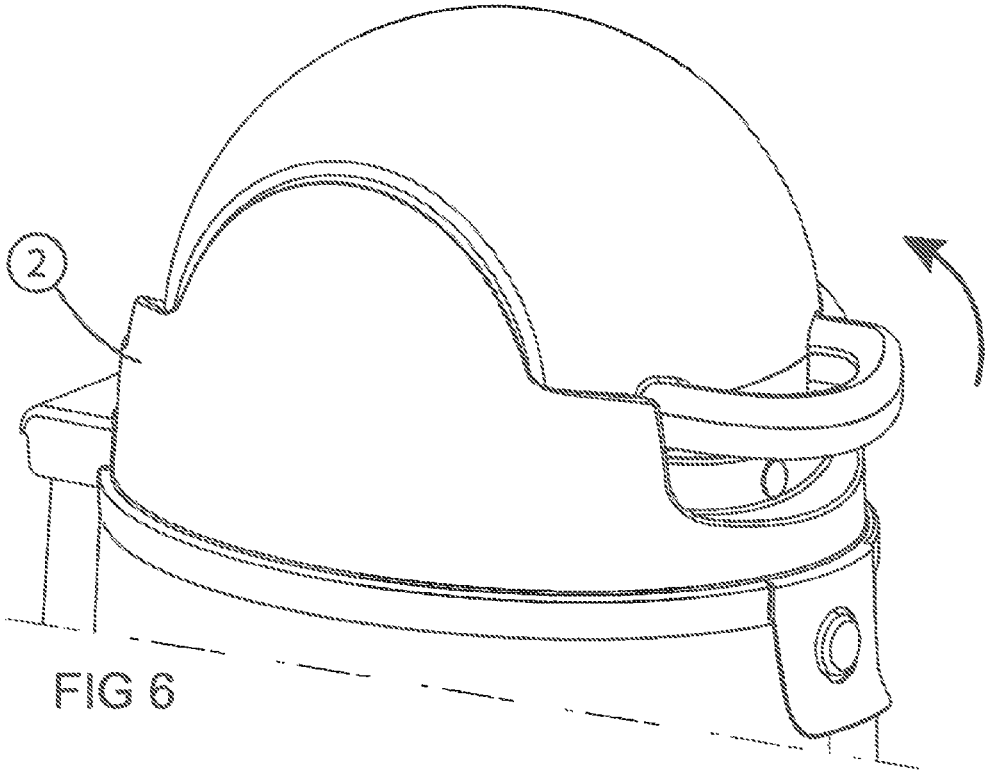
FIG. 6 is a perspective view of the complete upper part of the device, corresponding with the second or expel position according to FIG. 5.
Figure 7:
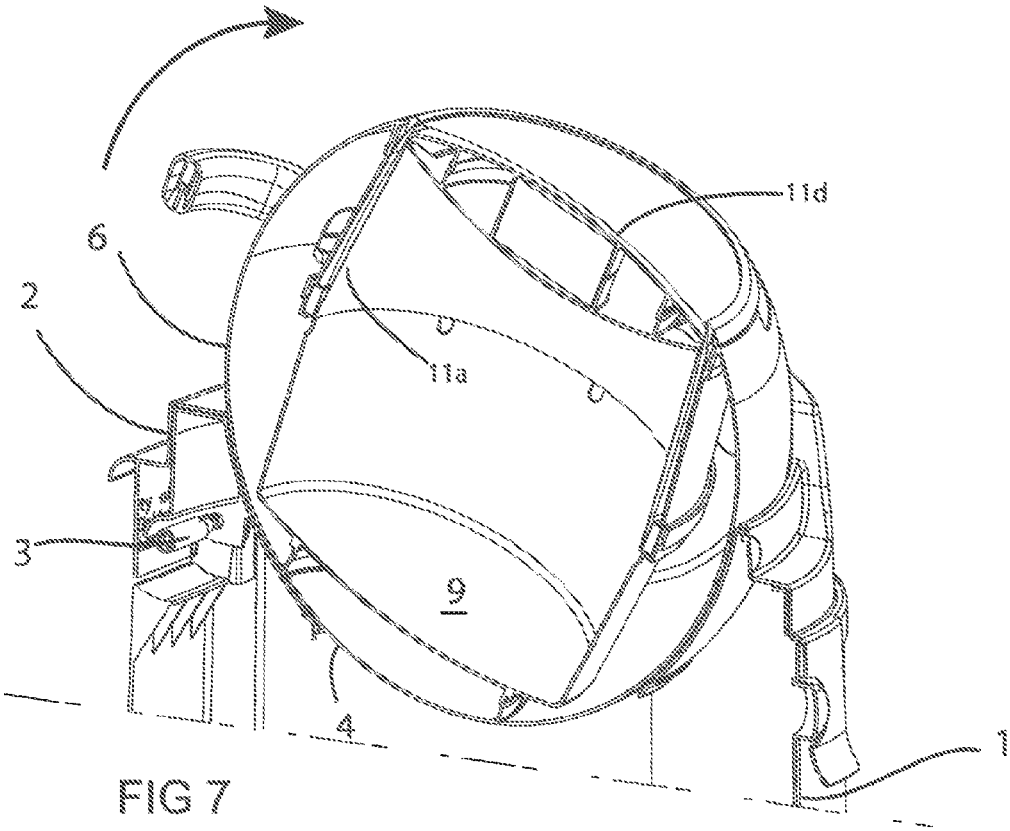
Figure 8:
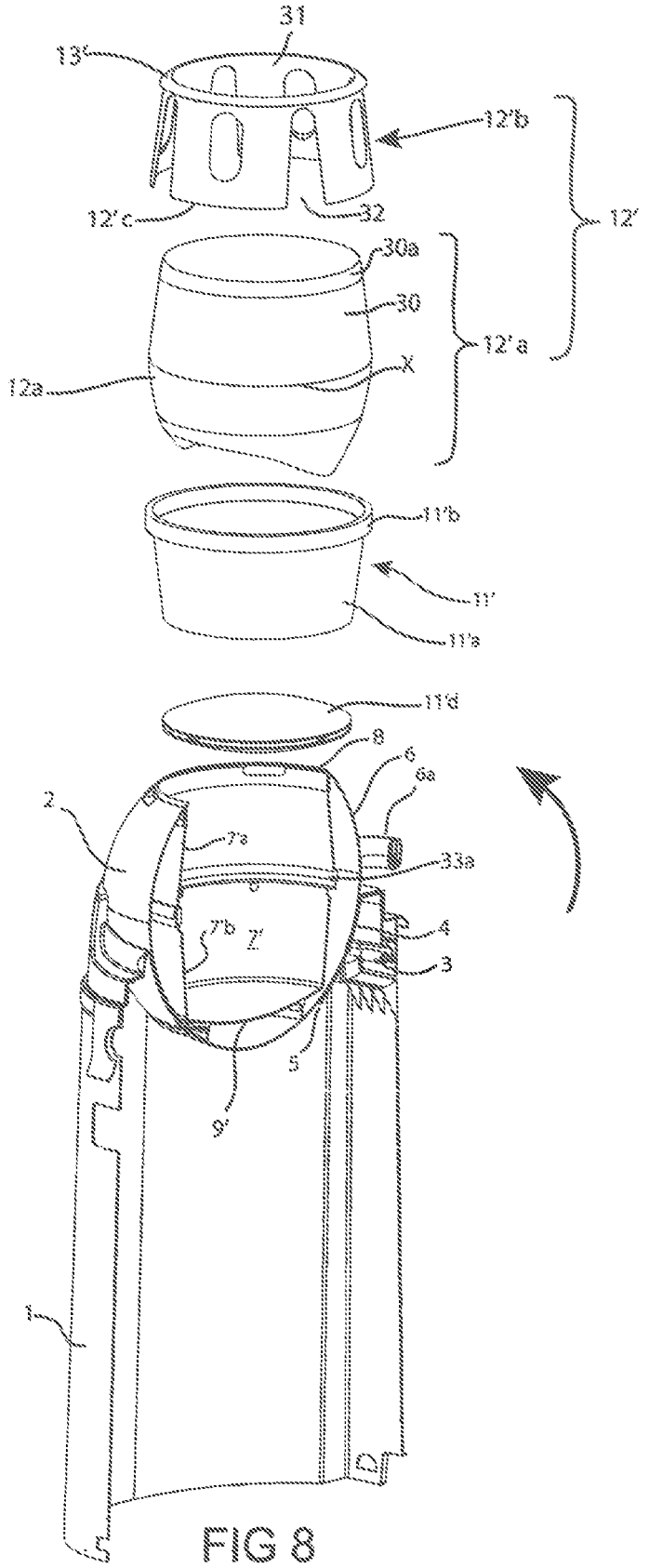

FIG. 7 is a perspective view as represented in FIG. 5, but now at a moment immediately after turning back from the expel position according to FIG. 5 into the first position according to FIGS. 1 and 2; and FIGS. 8 en 9 represent a variant of the device according to FIGS. 1-7, wherein an alternative chamber form and a particular embodiment of an adapted transfer bag are shown in a perspective view and in a vertical sectional view respectively.

The device shown in FIGS. 1-7 comprises a collecting container 1, which in the represented situations is closed by a cover 3, that is pivotally connected to the container 1 about an axis 3. In use, the container contains a disposable bag (not shown), which—when filled—is exchanged for a new one by pivoting the cover 2 about the axis 3 into an open position. The cover 2 comprises a semi-spherically formed shell portion 4 (vide FIG. 3 in particular) having in its bottom a circular opening, that opens into the space within the container 1, i.e. within the bag placed therein. The edge of this opening is indicated at 5.

Within the shell portion 4 a substantially spherical cover section is pivotally mounted about a horizontal axis (not shown) through the common centre of the shell portion and the cover section 6. The cover section 6 can be moved by hand between a first position or deposit position (FIGS. 1 and 2) and a second or expel position (FIGS. 5 and 6) and is for that purpose provided with a handle 6*a*. Diametrically within the spherical cover section 6 a stepped cylindrical chamber 7 is provided, the axis of which extends perpendicularly to the horizontal rotary axis (not shown) of the cover section 6. The chamber 7 comprises two sections 7*a* and 7*b* with a small mutual difference in diameter, the connection between the two sections being formed by a rather narrow shoulder face perpendicular to the axis of the chamber.

At one end of the chamber 7—on the side of the chamber section 7*a* having the larger diameter—there is provided an inlet/outlet opening 8, whereas the opposite end of the chamber—on the side of the chamber section 7*b* having the smaller diameter—is closed by a bottom wall 9. The inlet/outlet opening 8 coincides with a corresponding opening in the spherical cover section 6, which is surrounded by a circular groove 10.

Figure 3:
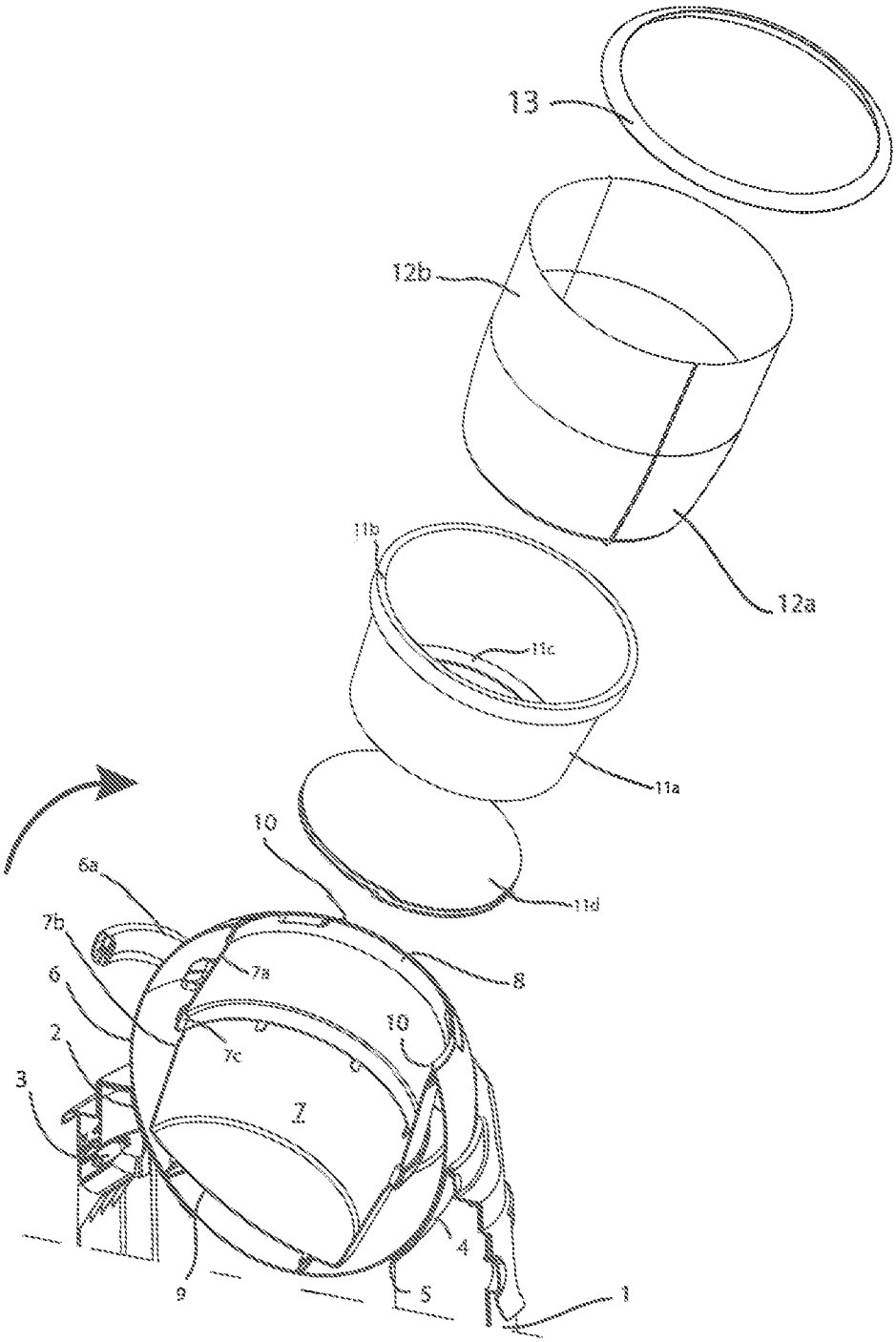
FIG. 3 is a perspective view as represented in FIG. 2, wherein the various parts of the auxiliary bag/transfer bag assembly are shown in the order of their assembly, mounting and locking up in the chamber.
Figure 4:
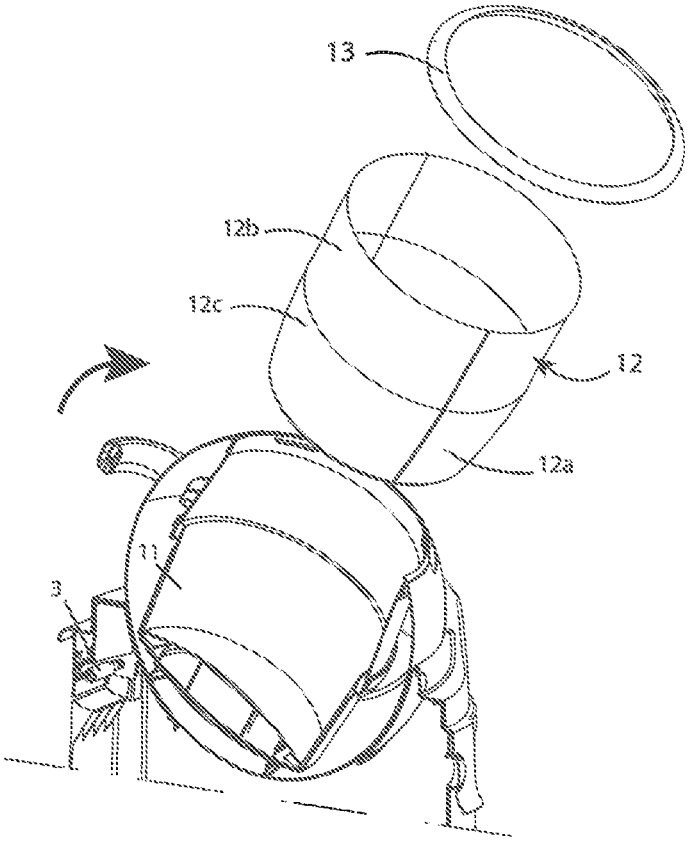
FIG. 4 is a perspective view as represented in FIGS. 2 and 3, but now only with the auxiliary bag mounted in place within the chamber, while the transfer bag and the locking ring are still outside the chamber.

An assembly of two substantially flexible bags 11 and 12 is provided within the chamber 7 (vide FIG. 3). Bag 11 is to be considered as an auxiliary bag; in use this bag is not subjected to fouling and therefore needs not to be exchanged periodically.

The auxiliary bag 11 has a flexible circumferential wall 11*a*, which has one of its terminal edges fastened to the inner circumference of a flange ring 11*b*, whereas its other, slightly radially inwardly extending terminal edge 11*c* is to be fastened, by gluing or otherwise, in a circumferential groove of the bag bottom 11*d* that functions as an expel body. Preferably the flange ring 11*b* is formed as a radially outwardly functioning pinch ring.

In contrast with the auxiliary bag 11, the bag 12 (which will be hereinafter called "transfer bag") comes into direct contact with the soiled objects and thus needs to be frequently exchanged by a new one. The transfer bag 12 comprises a flexible part 12*a* and a cylindrical part 12*b* of a more rigid material, the latter part forming a collar, that extends from the mouth edge of the flexible part 12*a* in axial direction as far as the inlet/outlet opening 8. The transfer bag 12 will hereinafter be described in more detail.

When placing the auxiliary bag/transfer bag assembly—in the position according to FIG. 3—the auxiliary bag 11 is placed first, in such a way that its flange ring sealingly engages the shoulder face that functions as a support face. The weight of the expel body 11*d* will thereby cause the flexible bag wall 11*a* to hang down, while stretched, into the chamber section having the smaller diameter (vide FIG. 4). Then the bag 12 is placed with the collar edge 12*c* supporting on the face of the flange ring 11*b* that was placed earlier and is directed towards the inlet/outlet opening 8. The flexible part 12*a* of the transfer bag is pushed by hand into the depending flexible wall 11*a* of the auxiliary bag 11. Finally the locking ring 13, e.g. configured as a click ring, is put in place. By means of this locking ring both a mechanically and hermetically secured attachment of the transfer bag within the chamber can be easily realized, so that the air between the two bags form a sealed air cushion, which may function as a connection between the two bags.

The locking ring 13 has—in cooperating with the annular groove 10 (FIG. 3)—also a sealing function when the cover section 6 is moving from the first position (FIG. 1) to the second or expel position (vide FIGS. 5 and 6). In the latter position a fouled object, which was received by the bag assembly within the chamber in an earlier stage, is expelled into the collecting container. The expel action primarily takes place under the influence of the weight of the expel body (=bottom of the auxiliary bag 11). The expel body 11*d* on top of the loaded transfer bag 12 pushes the latter simply downwards, whereby the object is expelled and the flexible section of the transfer bag will finally—with its bottom directed downwardly and turned inside out—get hanging within the collar 12*b*. The auxiliary bag 11*b*—suspending from the flange ring 11*b*-gets hanging within the inside out turned transfer bag. In this connection it is to be remarked, that in or near to the chamber bottom 9 a small opening may be provided, through which air can enter the chamber section 7*b* when the effective volume of the latter is increasing during the expel procedure.

In fact FIG. 5 illustrates the auxiliary bag/transfer bag assembly in the state at the end of the expel procedure. The position shown in FIGS. 5 (and 6) can be considered as the rest position of the whole device as well. For the device remains in this position until another soiled object has to be discharged into the collecting container. Not before that moment the cover section 6 is placed—by means of a rotary movement in the arrow direction (FIGS. 5 and 6)—into the first or deposit position (FIGS. 1, 2 and 8). FIG. 7 is representative for the situation at the moment immediately after the start of the returning movement from the expel position shown in FIG. 5 into the inlet position according to FIGS. 1 and 2. At this moment the auxiliary bag/transfer bag assembly is still in the same state as shown in FIG. 5, i.e. with the bags compactly inserted one into the other. However, soon thereafter the expel body 11*d* will move—due to its weight—to a position nearer to the chamber bottom 9.

This movement of the expel body 11*d* causes the flexible auxiliary bag section 11*a* and the transfer bag 12 connected to the former bag by means of the above mentioned air cushion, to move along. The auxiliary bag/transfer bag assembly extending (in FIG. 7) into chamber section 7*a* is thereby turned inside out and is—in this position—received in the chamber section 7*b* adjoining the chamber bottom 9.

The device is therewith ready to receive a soiled object.

After having been used for a selected number of times for the transfer of soiled objects to the collecting container 1, the transfer bag can be simply exchanged for a clean one. For this purpose only the locking ring 13 needs to be detached, after which the fouled transfer bag can be removed, the clean one can be put in place and the locking ring can be placed back (vide FIG. 4).

Figure 9:
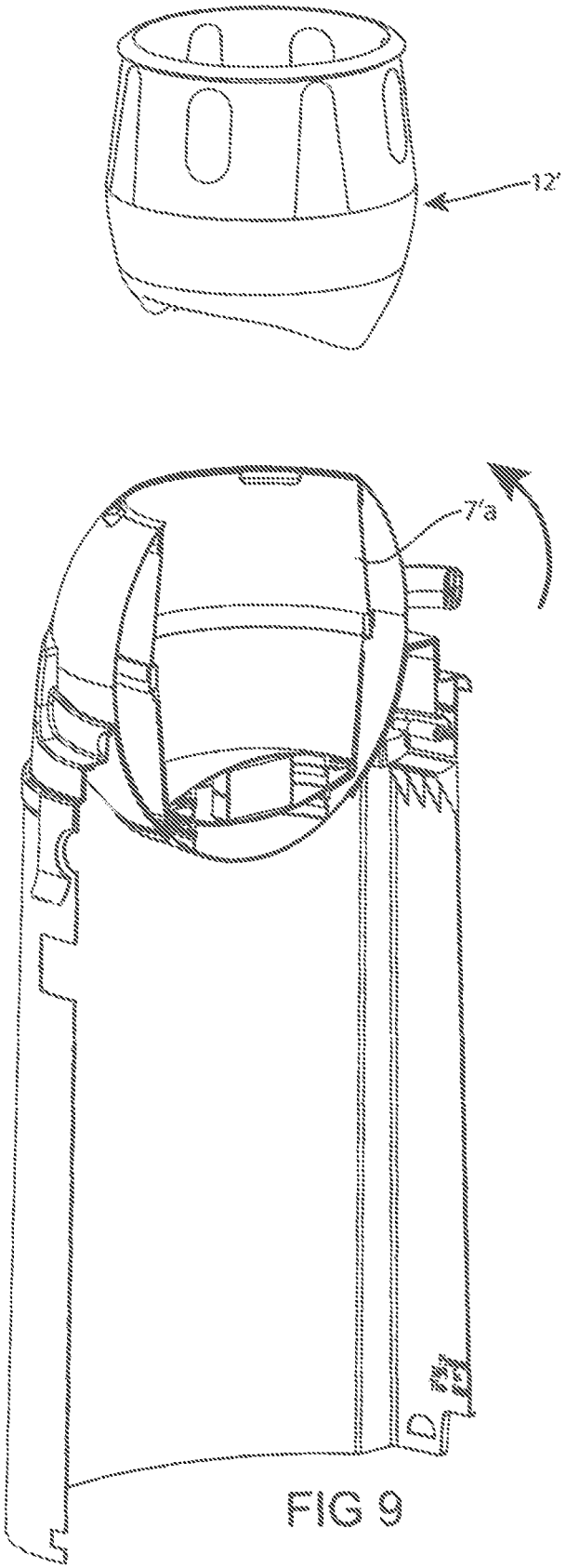

Reference is now made to FIGS. 8 and 9, in which the represented parts, which functionally correspond with those in the embodiment of the device above described, are indicated with the same reference numbers, but provided with an accent as far as carried out differently.

FIG. 8 shows the parts 12'*a* and 12'*b* of the alternative transfer bag 12', while disconnected from one another, whereas these parts are united to one piece in the representation according to FIG. 9.

An essential difference with the transfer bag according to FIG. 1-7 is, in the first place, that the collar 12'*b* is formed in one piece with the locking ring 13' and of a conical shape, and secondly, that the flexible bag section 12'*a* is extended beyond the level X by a portion 30 of the same flexible material. When uniting the two sections 12'*a* and 12'*b* the flexible bag portion 30 will get located entirely within or on the outer side of the collar (vide FIG. 9), whereas the two sections are permanently connected to one another, e.g. by effecting a glued joint or heat sealing connection between the upper marginal strip 30*a* of the flexible bag 12'*a* and the inner side of the neck 31 of the collar 12'*b*.

In the conical collar 12'*b* cuts or slits 32 are provided, which are evenly divided about the collar periphery and which start at the collar neck and merge into the (lower) terminal edge 12'*c* of the collar. These cuts or slits 32 make it possible for the collar 12'*b* and thereby for the whole transfer bag assembly to contract or to be radially compressed to an extent that allows its removal from the chamber or placement into the chamber through the inlet/outlet opening 8. The advantage of the represented collar shape with slits is, that the collar, while expanding after it has been inserted (in a radially compressed state) through the inlet/outlet opening 8, gets lying against the chamber wall under a certain pressure. This applies e.g. for a cylindrical chamber wall, such as the chamber wall section 7*a* in the embodiment according to FIGS. 1-7. In the embodiment according to FIGS. 8 and 9, however, the corresponding chamber wall section 7'*a* is also conically widened in shape, but to a smaller degree than the collar 12'*b*, so that also in this case the collar gets lying against the chamber wall under a certain pressure.

Halfway the chamber 7' the conical chamber wall section 7'*a* connects to the chamber section 7'*b* that conically narrows towards the chamber bottom 9'. This form of the chamber wall 7'*a*, 7'*b* has the advantage, that two defined end positions can be created for a (disc-shaped) expel body, between which the expel body may carry out effective strokes.

This applies for a loose, independently moving expel disc as well as for an expel disc that—similar to the embodiment according to FIGS. 1-7—constitutes the bottom of an auxiliary bag. In case of an independently movable expel disc, however, it is to be recommended to choose the end position on the side of the inlet/outlet opening not closer to the latter opening than about halfway the conical collar 12'*b* in order to be assured of a sufficient unfolding of the transfer bag when returning from the expel position back to the inlet or deposit position.

FIGS. 8 and 9 show the preferred use of an expel disc 11'*d* as a part (viz. The bottom) of an auxiliary bag 11'. This auxiliary bag has a flexible, preferably conically shaped circumferential wall 11'*a*, the wider mouth edge of which is attached to a flange ring 11'*b* and the opposite end of which is fastened (in a manner that is not shown) to the expel disc 11'*d*.

The attachment of the auxiliary bag 11' within the chamber takes place by means of the flange ring 11'*b* which has to be mounted into an annular groove 33 provided between the chamber wall sections 7'*a* and 7'*b*. For this purpose the flange ring is radially compressible for placement into and subsequent expansion and locking within the groove 33 (vide FIG. 9). In fact this manner of fastening is similar to that of the transfer bag with the well-known device described hereinabove. However, the attachment of the auxiliary bag 11' with the device according to the invention is of a substantially permanent character, so that the disadvantage of a difficult detachability associated with this method of attachment plays no role herewith.

The final mounting step is the installation of the transfer bag 12' in the chamber 7' through the inlet/outlet opening 8, which step needs not to be explained any further.

As far as the method of working of the embodiment according to FIGS. 8-9 is concerned, for the sake of brevity, reference can be made to the analogical method of working of the device according to FIGS. 1-7, as described hereinabove.

The invention claimed is:

1. A device for collecting soiled objects, the device comprising:

a cover; and a collecting container closable by the cover, wherein said cover comprises a section with a tubular chamber having a length that is open at one end and thereby provided with an inlet/outlet opening, said cover section being movable in use—with the collecting container closed—between a first position, in which an object may be deposited from outside through said opening into said chamber, and a second position, in which said object may drop through said opening into the collecting container, wherein the device further comprises:

a transfer bag of a flexible material that is removably mounted within said tubular chamber, said transfer bag being open at one end and having a bottom cooperating with an expel body at the opposite end, wherein the transfer bag comprises a collar, wherein the collar is rigid as compared with the flexibility of the flexible material of the transfer bag and has a height that is half the length of said tubular chamber, and said transfer bag can be moved into/out of said chamber and locked therein against undesired outward movement by a locking ring that cooperates with an edge of said opening at one end of said tubular chamber.

2. A device according to claim 1, wherein the locking ring is configured as a click ring.

3. A device according to claim 1, wherein within the tubular chamber a second or auxiliary bag is provided, the mouth edge of which engages the tubular chamber wall round about so as to divide the chamber into two sections located one behind the other and the flexible circumferential wall of which hangs down—when said cover section is in said first position—into the tubular chamber section at the closed end of the chamber, around the end of the transfer bag also hanging therein, the bottom of said auxiliary bag being constituted by said expel body.

4. A device according to claim 1, wherein the cover comprises an annular groove for receiving at least a portion of the locking ring therein when the locking ring cooperates with the edge of said opening.

5. A device according to claim 1, wherein the soiled objects are diapers.

6. A device according to claim 1, wherein said locking ring forms an integral part of said collar.

7. A device according to claim 6, wherein said locking ring is a flange extending outwardly from said collar.

8. A device according to claim 1, wherein, starting from a collar neck portion, that corresponds with the inlet/outlet opening, the collar is conically widening and is—against spring action—radially inwardly contractible or compressible to a circumferential size that corresponds with the size of said inlet/outlet opening.

9. A device according to claim 8, wherein the collar is provided with cuts or slits which are evenly divided around the collar periphery and start at said collar neck portion and merge into the terminal edge of the collar turned away from the collar neck portion.

10. A device according to claim 8, wherein starting from said inlet/outlet opening, the tubular chamber wall is at first conically widening through a length corresponding to the collar height and then—from a location halfway the tubular chamber—conically narrowing, the cone angles of both of the tubular chamber wall sections being smaller than that of the collar in its completely expanded, tensionless state.

11. A device for collecting soiled objects, the device comprising:

a cover; and a collecting container closable by the cover, wherein said cover comprises a section with a tubular chamber having a length that is open at one end and thereby provided with an inlet/outlet opening, said cover section being movable in use—with the collecting container closed—between a first position, in which an object may be deposited from outside through said opening into said chamber, and a second position, in which said object may drop through said opening into the collecting container, wherein the device further comprises:

a transfer bag of a flexible material that is removably mounted within said tubular chamber, said transfer bag being open at one end and having a bottom cooperating with an expel body at the opposite end, wherein the transfer bag comprises a collar, wherein the collar is rigid as compared with the flexibility of the flexible material of the transfer bag, and said transfer bag can be moved into/out of said chamber and locked therein against undesired outward movement by a locking ring that cooperates with an edge of said opening at one end of said tubular chamber.

12. A device according to claim 11, wherein the locking ring is configured as a click ring.

13. A device according to claim 11, wherein within the tubular chamber a second or auxiliary bag is provided, the mouth edge of which engages the tubular chamber wall round about so as to divide the chamber into two sections located one behind the other and the flexible circumferential wall of which hangs down—when said cover section is in said first position—into the tubular chamber section at the closed end of the chamber, around the end of the transfer bag also hanging therein, the bottom of said auxiliary bag being constituted by said expel body.

14. A device according to claim 11, wherein said locking ring forms an integral part of said collar.

15. A device according to claim 14, wherein said locking ring is a flange extending outwardly from said collar.

16. A device according to claim 11, wherein, starting from a collar neck portion, that corresponds with the inlet/outlet opening, the collar is conically widening and is—against spring action—radially inwardly contractible or compressible to a circumferential size that corresponds with the size of said inlet/outlet opening.

17. A device according to claim 16, wherein the collar is provided with cuts or slits which are evenly divided around the collar periphery and start at said collar neck portion and merge into the terminal edge of the collar turned away from the collar neck portion.

18. A device according to claim 16, wherein starting from said inlet/outlet opening, the tubular chamber wall is at first conically widening through a length corresponding to the collar height and then—from a location halfway the tubular chamber—conically narrowing, the cone angles of both of the tubular chamber wall sections being smaller than that of the collar in its completely expanded, tensionless state.

* * * * *